US007147222B2

(12) United States Patent
Christensen et al.

(10) Patent No.: US 7,147,222 B2
(45) Date of Patent: Dec. 12, 2006

(54) METHOD AND APPARATUS FOR REGISTERING SHEET OF ARBITRARY SIZE

(75) Inventors: Larry L. Christensen, Henrietta, NY (US); Woogie S. Son, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 272 days.

(21) Appl. No.: 10/418,378

(22) Filed: Apr. 18, 2003

(65) Prior Publication Data

US 2004/0119226 A1 Jun. 24, 2004

Related U.S. Application Data

(60) Provisional application No. 60/434,859, filed on Dec. 19, 2002.

(51) Int. Cl.
*B65H 7/02* (2006.01)

(52) U.S. Cl. ..... 271/228; 271/227

(58) Field of Classification Search ..... 271/227, 271/228

See application file for complete search history.

(56) References Cited

U.S. PATENT DOCUMENTS 5,322,273 A 6/1994 Rapkin et al.
5,918,876 A 7/1999 Maruyama et al.
6,005,683 A 12/1999 Son et al.
6,209,866 B1 * 4/2001 Hosking et al. ..... 271/228
6,271,535 B1 * 8/2001 Seachman et al. ..... 250/548
7,007,788 B1 * 3/2006 Dunlop et al. ..... 194/207
2001/0040331 A1 * 11/2001 Forch et al. ..... 270/58.01
2001/0040994 A1 * 11/2001 Jang et al. ..... 382/135

FOREIGN PATENT DOCUMENTS

EP 1 348 661 A1 * 3/2003

OTHER PUBLICATIONS

Volkmar et al., Process Technologies for High-Resolution Infrared Detectors Based on LiTaO3, DIAS Infared GmbH—Publications—No. 11, Whole document, Publication Date not indicated.*

* cited by examiner

*Primary Examiner*—Patrick Mackey
*Assistant Examiner*—Kaitlin Joerger
(74) *Attorney, Agent, or Firm*—Donna P. Suchy

(57) ABSTRACT

A method measures the location of a sheet and then moves the sheet to a registered position. By measuring the actual location of the sheet and then moving the sheet to the registered position, the invention saves a substantial amount of time. An elongated array of LED sensors 130 stretches over several inches and is aligned with a collimated light source 110. Each sensor in the array is spaced from its adjacent sensor by a known amount. This amount can be as small as a few tens of thousandths of an inch. The edge of a sheet covers the sensors. The sheet edge is measured and the registration device moves the edge of the sheet to the registered position for receiving the developed image.

10 Claims, 5 Drawing Sheets

METHOD AND APPARATUS FOR REGISTERING SHEET OF ARBITRARY SIZE

CROSS-REFERENCE TO RELATED APPLICATIONS

This application claims the benefit of the priority filing date of U.S. provisional patent application Ser. No. 60/434,859 filed Dec. 19, 2002.

FIELD OF THE INVENTION

This invention relates in general to electrographic print engines, and in particular, to a method and apparatus for registering copy sheets with a developed image.

BACKGROUND

Printers and copiers that transfer a toner developed image to a copy sheet have a common problem. All such machines need to accurately register the copy sheet with the image. This can be difficult because the copy sheet and the image may be traveling at different speeds and along different paths. Some have attempted to solve this problem by driving a copy sheet to a fixed gate, but such a technique is generally slow. In modern, high-speed electrographic machines, copy sheets are often registered using opto-electronic systems. Such systems provide added speed and certainty of position.

As a copy sheet approaches its registration position, a suitable registering mechanism straightens the sheet and moves it to its registered position. In order to do this, it is often necessary to axially align the sheet by removing any angular rotation that the sheet may have with respect to the developed image. Once the sheet is axially aligned or otherwise taken out of skew, the sheet must then be jogged into its desired position. A mechanism for removing the skew and for jogging the sheet to its registered position is shown and described in U.S. Pat. No. 5,322,273, whose entire disclosure is herein incorporated by reference.

While the mechanism described above is capable of handling the sheet, the problem remains of how to determine the proper position for the sheet. In at least one prior art system, the problem is solved by using multiple pairs of light emitting diodes and photodetectors. The LEDs and photodiodes are positioned transverse to the sheet's path. The opto-electrical components are mounted on circuit boards that are fixed with respect to the registration mechanism. Multiple pairs of discrete LEDs and photodiodes are used in order to derive edge sensors for different size sheets, such as type letter, legal size, A4 and other sizes. In operation, the registering mechanism first removes the skew from the sheet before the photodiodes and LEDs are operated. The sheet is stopped by the registration mechanism and is moved in one direction and then in the opposite direction until the edge of the sheet just covers or reduces the light received by the photodiode that senses the edge of the sheet. In order words, the sheet is entirely removed from the path of the photodiode and then is incrementally moved back toward the photodiode corresponding to the known sheet length until the edge of the sheet is detected.

Such prior art systems have the advantage of providing certainty of location and are highly reliable. By systematically driving the sheet away from the photodiode and then back towards it until its light is initially attenuated, one can very accurately detect the edge of the sheet. Once the edge of the sheet is detected, the sheet can be jogged to a final reference position. Thereafter, the sheet is released from the registration mechanism and is fed into a transfer station where the toned image is transferred to the suitable registered copy sheet.

Although such registration systems are reliable, they still have a number of drawbacks. They are inherently slow because they must always move the sheet once the sheet is in the registering mechanism. This requires stopping the sheet and jogging the sheet in opposite directions. As productivity demands for electrographic machines increase almost to the level of small printing presses, the time it takes to stop and jog a sheet to register the copy sheet is no longer acceptable. In addition, such systems cannot, without modification, register arbitrary size paper. They depend upon standard size papers for operating a pair of sensors that corresponds to the anticipated size of the paper. If a paper with a non-standard size is used as a copy sheet, the machine cannot accurately register the paper. To do that, the registration system has to be altered to include a further set of sensors designed to register the non-standard paper. However, another non-standard paper size will require still another modification to the machine and another pair of sensors. Therefore, the problem of providing a reliable and fast apparatus for registering copy sheets and for providing a system that can register any size copy sheet remains unsolved.

SUMMARY

The invention solves the problem of the prior art by dispensing with the technique of moving the sheet to a predetermined register location. Instead, the invention actively measures the unskewed position of the sheet and then moves the sheet to the desired registered position. By measuring the actual location of the sheet and then moving the sheet to the registered position, the invention saves a substantial amount of time. No longer does the machine have to stop the sheet, move it in one direction and then the other and thereby incur acceleration and deceleration losses. Instead, the invention keeps the copy sheet in near continuous motion so that the time spent by the sheet in the registration station is substantially reduced. By using this technique of measuring the sheet rather than mere edge detection, the invention registers sheets of known size as well as sheets of arbitrary length.

In one embodiment of the invention, an elongated array of LED sensors stretches over several inches and is aligned with a collimated light source. Each sensor is spaced from its adjacent sensor by a known amount. This amount can be as small as a few tens of thousandths of an inch. By knowing where the edge of the sheet is relative to such a linear array, cross-tracking motors in the registration device can readily move the edge of the sheet to its proper registered position for receiving the developed image.

It is also be possible to use a single light source without collimating it together with one or more arrays of light sensors. One problem with using a single light source for multiple sensors is parallax. In addition, the light source might have to be made so intense that the light might even penetrate edges of the sheet and give a false reading.

Still another embodiment of the invention, it provides multiple pairs of light sources and arrays. The arrays are exposed on opposite sides of a path of the copy sheet. There is one light source per array. The parallax problem is solved by simple trigonometry and its solution is stored in the memory of a computer that normally operates the machine.

DETAILED DESCRIPTION

Figure 1:
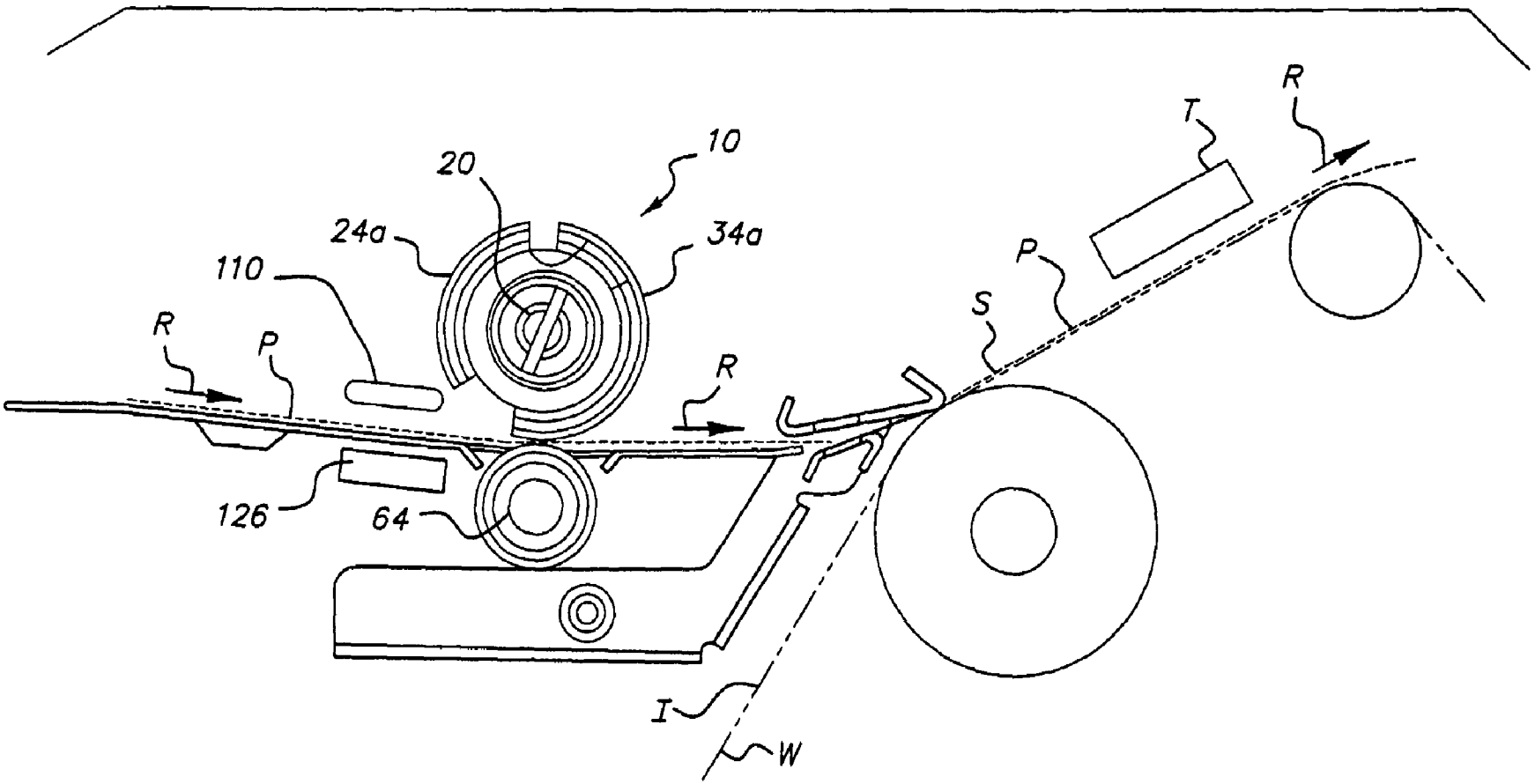
FIG. 1 is a side elevation view of the sheet registration mechanism, according to this invention, partly in cross-section, and with portions removed to facilitate viewing.
Figure 2:
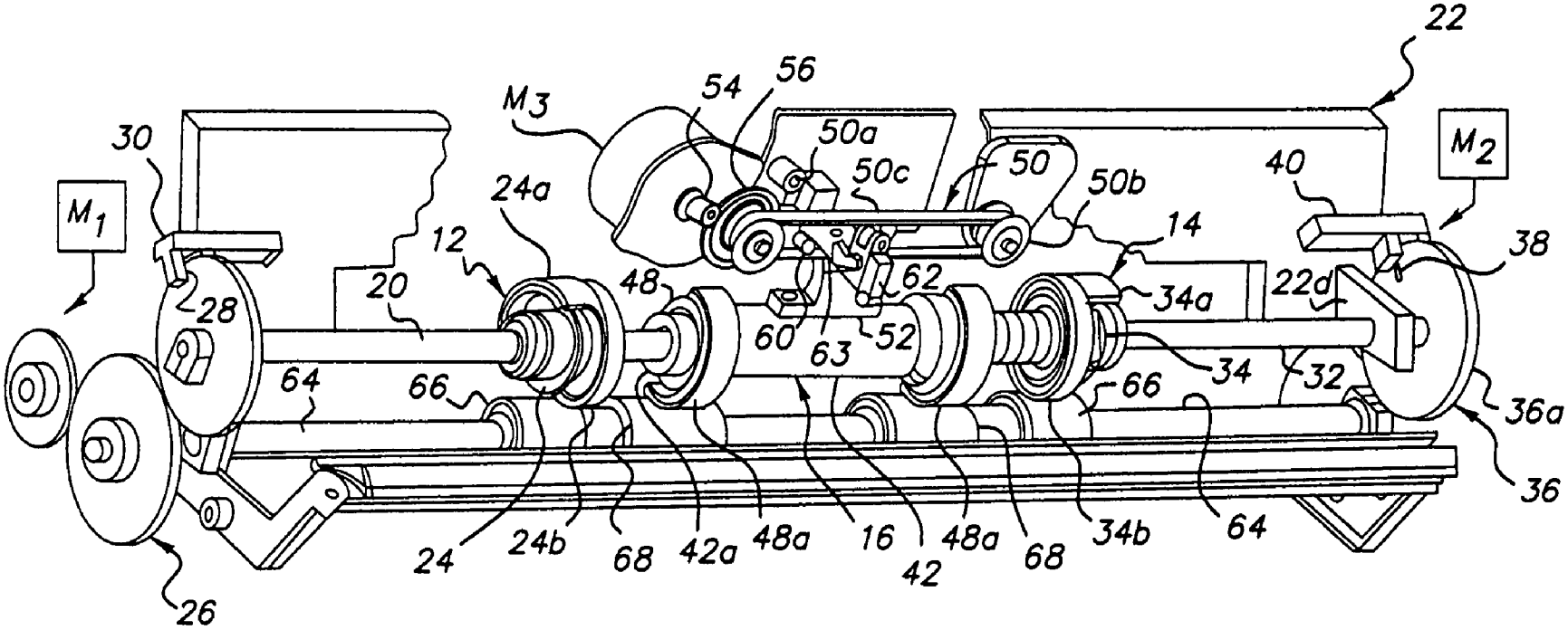
FIG. 2 is a view, in perspective, of the sheet registration mechanism of FIG. 1, with portions removed or broken away to facilitate viewing.
Figure 3:
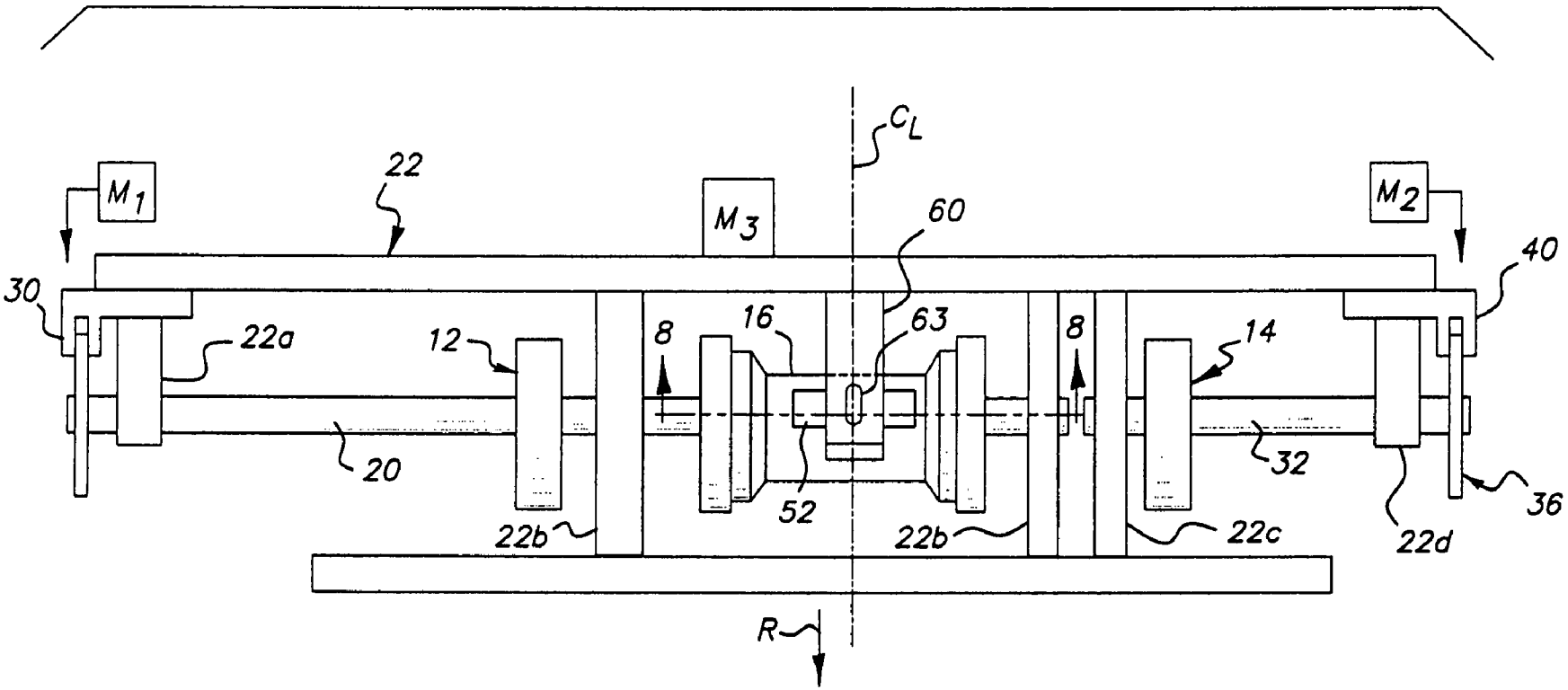
FIG. 3 is a top plan view of the sheet registration mechanism of FIG. 1, with portions removed or broken away to facilitate viewing.

Referring now to the accompanying drawings, FIGS. 1–3 best show the sheet registration mechanism, designated generally by the numeral 10. It is located in association with a substantially planar sheet transport path P of any well known device where sheets are transported seriatim from a supply (not shown) to a station where an operation is performed on the respective sheets. For example, the device may be a reproduction apparatus, such as a copier or printer or the like, where marking particle developed images of original information, are placed on receiver sheets. Marking particle developed images (e.g., image I) are transferred at a transfer station T from a movable web or drum (e.g., web W) to a sheet of receiver material (e.g., a cut sheet S of plain paper or transparency material) moving along the path P.

In reproduction apparatus of the above type, it is desired that the sheet S be properly registered with respect to a marking particle developed image in order for the image to be placed on the sheet in an orientation to form a suitable reproduction for user acceptability. Accordingly, the sheet registration mechanism 10 provides for alignment of the receiver sheet in a plurality of orthogonal directions. That is, the sheet is aligned, with the marking particle developed image, by the sheet registration mechanism by removing any skew in the sheet (angular deviation relative to the image), and moving the sheet in a cross-track direction so that the centerline of the sheet in the direction of sheet travel and the centerline of the marking particle image are coincident. Further, the sheet registration mechanism 10 times the advancement of the sheet along the path P such that the sheet and the marking particle image are aligned in the in-track direction as the sheet travels through the transfer station T.

In order to accomplish skew correction and cross-track and in-track alignment of the sheet, for example with respect to a marking particle developed image on the moving web W, the sheet registration apparatus 10 includes first and second independently driven roller assemblies 12, 14, and a third roller assembly 16. The first roller assembly 12 includes a first shaft 20 supported adjacent its ends in bearings 22*a*, 22*b* mounted on a frame 22. Support for the first shaft 20 is selected such that the first shaft is located with its longitudinal axis lying in a plane parallel to the plane through the sheet transport path P and substantially perpendicular to the direction of a sheet traveling along the transport path in the direction of arrows R (FIG. 1).

A first urging roller 24 is mounted on the first shaft 20 for rotation therewith. The urging roller 24 has an arcuate peripheral segment 24*a* extending about 180 degrees around such roller. The peripheral segment 24*a* has a radius to its surface measured from the longitudinal axis of the first shaft 20 substantially equal to the minimum distance of such longitudinal axis from the plane of the transport path P. A first stepper motor M1, mounted on the frame 22, is operatively coupled to the first shaft 20 through a gear train 26 to rotate the first shaft when the motor is activated. The gear 26*a* of the gear train 26 incorporates indicia 28 detectable by a suitable sensor mechanism 30. The sensor mechanism 30 can be either optical or mechanical depending upon the selected indicia. Location of the sensor mechanism 30 is selected such that when the indicia 28 is detected, the first shaft 20 will be angularly oriented to position the first urging roller 24 in a home position. The home position of the first urging roller is that angular orientation where the surface of the arcuate peripheral segment 24*a* of the roller 24, upon further rotation of the shaft 20, will contact a sheet in the transport path P.

The second roller assembly 14 includes a second shaft 32 supported adjacent its ends in bearings 22*c*, 22*d* mounted on the frame 22. Support of the second shaft 32 is selected such that the second shaft is located with its longitudinal axis lying in a plane parallel to the plane through the sheet transport path P and substantially perpendicular to the direction of a sheet traveling along the transport path. Further, the longitudinal axis of the second shaft 32 is substantially coaxial with the longitudinal axis of the first shaft 20.

A second urging roller 34 is mounted on the second shaft 32 for rotation therewith. The urging roller 34 has an arcuate peripheral segment 34*a* extending about 180 degree around such roller. The peripheral segment 34*a* has a radius to its surface measured from the longitudinal axis of the first shaft 20 substantially equal to the minimum distance of such longitudinal axis from the plane of the transport path P. The arcuate peripheral segment 34*a* is angularly coincident with the arcuate peripheral segment 24*a* of the urging roller 24. A second independent stepper motor M2, mounted on the frame 22, is operatively coupled to the second shaft 32 through a gear train 36 to rotate the second shaft when the motor is activated. The gear 36*a* of the gear train 36 incorporates indicia 38 detectable by a suitable sensor mechanism 40. The sensor mechanism 40, adjustably mounted on the frame 22, can be either optical or mechanical depending upon the selected indicia. Location of the sensor mechanism 40 is selected such that when the indicia 38 is detected, the second shaft 32 will be angularly oriented to position the second urging roller 34 in a home position. The home position of the second urging roller is that angular orientation where the surface of the arcuate peripheral segment 34*a* of the roller 34, upon further rotation of the shaft 32, will contact a sheet in the transport path P.

The third roller assembly 16 includes a tube 42 surrounding the first shaft 20 and capable of movement relative to the first shaft in the direction of the longitudinal axis thereof. A pair of third urging rollers 48 are mounted on the first shaft 20, supporting the tube 42 for relative rotation with respect to the third urging rollers. The third urging rollers 48 respectively have an arcuate peripheral segment 48*a* extending about 180 degree around each roller. The peripheral segments 48*a* each have a radius to its respective surface measured from the longitudinal axis of the first shaft 20 substantially equal to the minimum distance of such longitudinal axis from the plane of the transport path P. The arcuate peripheral segments 48*a* are angularly offset with respect to the arcuate peripheral segments 24*a*, 34*a* of the first and second urging rollers. The pair of third urging rollers 48 is coupled to the first shaft 20 by a key or pin 44 engaging a slot 46 in the respective rollers. Accordingly, the third urging rollers 48 will be rotated by drive shaft 20 when the first shaft is rotated by the first stepper motor M1, and are movable in the direction along the longitudinal axis of the first shaft with the tube 42. For the purpose to be more fully explained below, the angular orientation of the third urging rollers 48 is such that the arcuate peripheral segments 48*a* thereof are offset relative to the arcuate peripheral segments 24*a* and 34*a*.

A third independent stepper motor M3, mounted on the frame 22, is operatively coupled to the tube 42 of the third roller assembly 16 to selectively move the third roller assembly in either direction along the longitudinal axis of the first shaft 20 when the motor is activated. The operative coupling between the third stepper motor M3 and the tube 42 is accomplished through a pulley and belt arrangement 50. The pulley and belt arrangement 50 includes a pair of pulleys 50*a*, 50*b*, mounted for rotation and in fixed spatial relation, for example, to a portion of the frame 22. A drive belt 50*c* entrained about the pulleys is connected to a bracket 52 which is in turn connected to the tube 42. A drive shaft 54 of the third stepper motor M3 is drivingly engaged with a gear 56 coaxially coupled to the pulley 50*a*. When the stepper motor M3 is activated, the gear 56 rotates the pulley 50*a* to move the belt 50*c* about its closed loop path. Depending upon the direction of rotation of the drive shaft 54, the bracket 52 (and thus the third roller assembly 16) is selectively moved in either direction along the longitudinal axis of the first shaft 20.

A plate 60 connected to the frame 22 incorporates an indicia 63 detectable by a suitable sensor mechanism 62. The sensor mechanism 62, adjustably mounted on the bracket 52, can be either optical or mechanical depending upon the selected indicia. Location of the sensor mechanism 62 is selected such that when the indicia 63 are detected, the third roller assembly 16 is located in a home position. The home position of the third roller assembly 16 is selected such that the third roller assembly is substantially centrally located relative to the cross-track direction of a sheet in the transport path P.

The frame 22 of the sheet registration mechanism 10 also supports a shaft 64 located generally below the plane of the sheet transport path P. Pairs of idler rollers 66 and 68 are mounted on the shaft 64 for free rotation. The rollers of the idler pair 66 are respectively aligned with the first urging roller 24 and the second urging roller 34. The rollers of the idler roller pair 68 are aligned with the respective third urging rollers 48, and extend in a longitudinal direction for a distance sufficient to accommodate for maintaining such alignment over the range of longitudinal movement of the third roller assembly 16. The spacing of the shaft 64 from the plane of the sheet transport path P and the diameter of the respective rollers of the idler roller pairs 66 and 68 are selected such that the rollers will respectively form a nip relation with the arcuate peripheral segments 24*a*, 34*a*, and 48*a* of the urging rollers. For example, the shaft 64 may be spring loaded in a direction urging such shaft toward the shafts 20, 32, where the idler roller pair 66 will engage spacer roller bearings 24*b*, 34*b*.

With the above described construction for the sheet registration mechanism 10 according to this invention, sheets traveling seriatim along the sheet transport path P are aligned by removing any skew (angular deviation) in the sheet to square the sheet up with respect to the path, and moving the sheet in a cross-track direction so that the centerline of the sheet in the direction of sheet travel and the centerline CL of the transport path P are coincident. Of course, the centerline CL is arranged to be coincident with the centerline of the downstream operation station (in the illustrated embodiment, the centerline of a marking particle image on the web W). The sheet registration mechanism 10 times the advancement of the sheet along the transport path P for alignment in the in-track direction (again referring to the illustrated embodiment, in register with the lead edge of a marking particle image on the web W).

Figure 6:
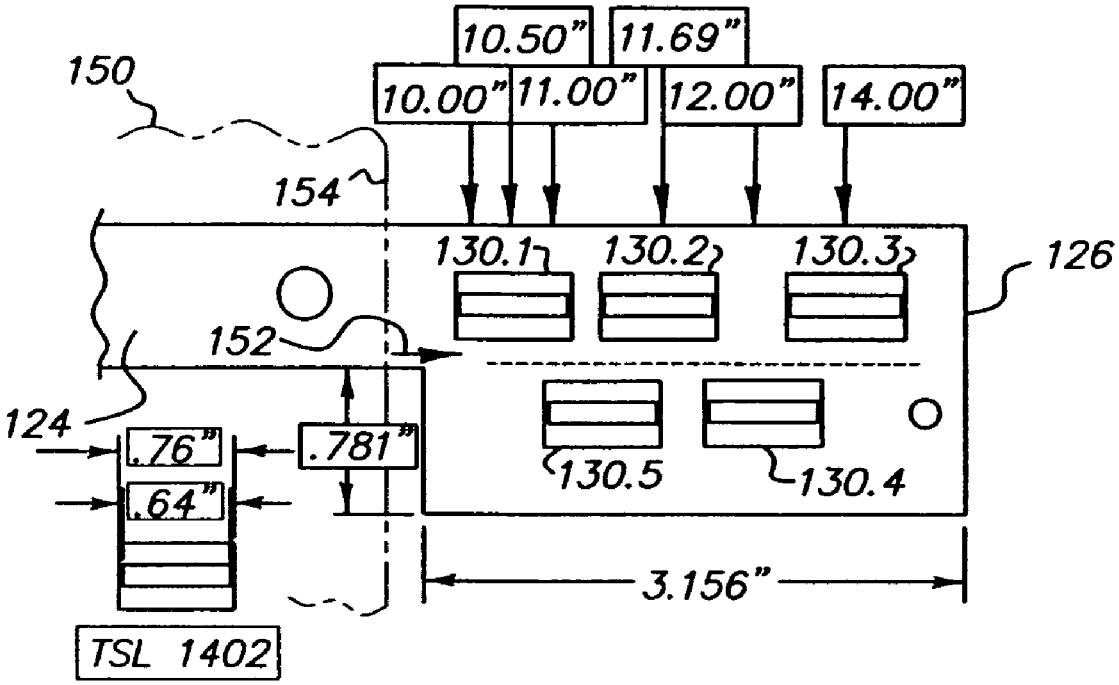
FIG. 6 is a plan view of a portion of a registration board with multiple arrays.
Figure 7:
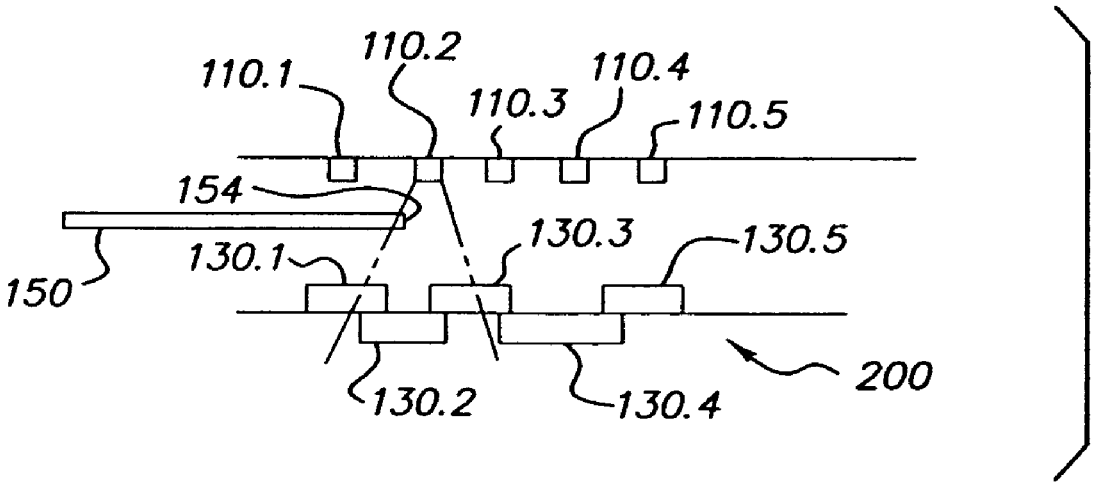
FIG. 7 is an end view of the portion of the registration board shown in FIG. 6.

In order to effect the desired skew removal, and cross-track and in-track sheet alignment, the mechanical elements of the sheet registration mechanism 10 according to this invention are operatively associated with a logic and control unit 70 (see FIG. 6). The control unit 70 is, for example, a microprocessor base controller receiving input signals from a plurality of sensors associated with the sheet registration mechanism and the downstream operation station. Based on such signals and a program resident in the microprocessor, the control unit 70 produces appropriate signals to control the independent stepper motors M1, M2, and M3 of the sheet registration mechanism. The production of a program for a number of commercially available microprocessors is a conventional skill well understood in the art. The particular details of any such program would, of course, depend on the architecture of the designated microprocessor.

Figure 4:
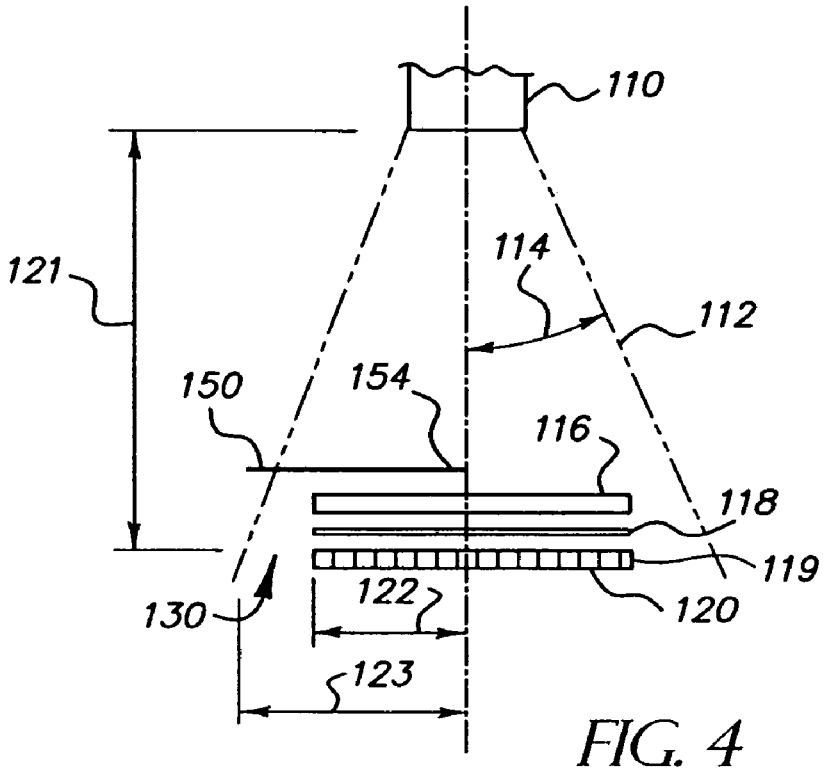
FIG. 4 is a top schematic illustration of the sheet transport path showing the actions of the sheet registration mechanism according to this invention on an individual sheet as it is transported along such transport path.

With reference to FIG. 4, there is shown an exemplary operating registration system provided with at least one light source 110 and one light sensor array 130. Typical light source 110 is a light emitting diode provided by Optek and identified by its part number OP232W. It outputs visible and infrared light. The optical sensor array 130 is provided by Taos and its part number is TSL1402. It includes a linear array of 256 photodiodes 119. A Wratten filter 87C 118 covers the photodiode array. The Wratten filter passes infrared radiation and excludes other radiation including invisible light. The filter is covered by a clear plastic lens 116. Light and infrared radiation from the source 110 travel toward the sensor array 130. The light diverges at an angle of about 20° from the center. Those skilled in the art will appreciate that this can create parallax between the edge of the paper 154 and the sensors 130. In other words, due to the angle of the impinging light, the edge of the paper 154 will accurately correspond to photodiode only when the paper is at the exact center of the array 130 as shown in FIG. 4. However, when the paper is near one end of the array, then the angle of light will cast a shadow of the paper on a photodiode that does not correspond to the exact length of the paper 150. Such problems are solved by trigonometry. See FIG. 4B. The angle of the light is known and the distance (d) between the paper and the photodiode is known. The distance between the last shadowed pixel PL and the pixel corresponding to the edge of the paper PE is distance. The distance times the difference between the shadowed pixel PL and the edge pixel PE, is equal to $d \tan \theta$.

Figure 5:
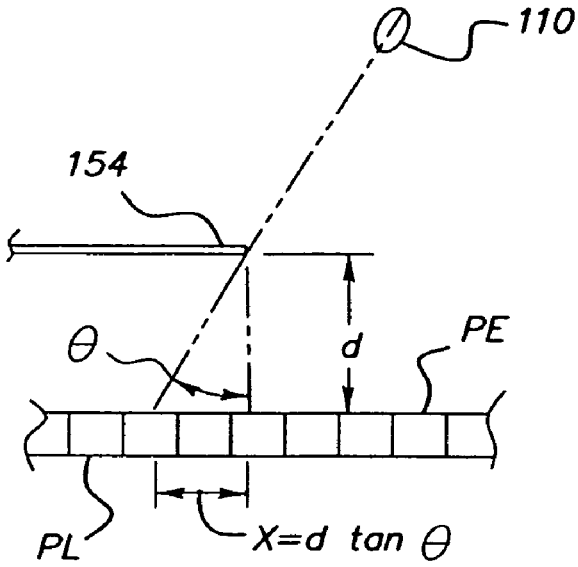
FIG. 5 is a schematic view of one light source opposite one array.

With reference to FIG. 5, there is shown a registration board 124. The board 124 is fixed with respect to the registration mechanism 10. The registration board has a number of LED sensor arrays 130.1–130.5. A copy sheet 150 is partially shown over the registration board 24. The sensors 130 are shown transverse to the path P that the sheet travels toward its registered position. The sheet sizes are shown on the edge 126 of the board. It is, in effect, an optical ruler that measures sheet length between about 10 inches and 14 inches with the sensor arrays 130.

The optical ruler system 200 is schematically illustrated in FIG. 6. The LEDs 110.1–110.5 a are disposed above and the aligned with the center of their corresponding photodiode array detectors 130.1–130.5. The multiple pairs of photodiodes and arrays are used to measure different sized sheets. For example, the pair 110.2 and 130.2 measure ordinary letter or 8.5"×11" size sheets. In operation, the size sheet is selected by the operator so that the machine in the system 200 knows that an 8.5"×11" sheet is expected. As such, the system will turn on photodiode 110.02. As the sheet 150 passes along its registration path, its leading edge 154 will interrupt the light falling upon the array 130.2. The registration machine will jog the machine 150 using the cross-tracking rollers until the edge of the sheet 154 covers the center pixel at the 11 inch position. The optical ruler 120 is generally housed in a light-tight environment. However, the Wratten filter is suitable for passing only one form of radiation, in particular, infrared. As such, even if some ambient visible light should inadvertently enter the system, the components will ignore the light because the Wratten filter will remove it.

The registration mechanism has suitable sensors, not shown, located on opposite sides of the mechanism for detecting the edges and confirming the edges are in alignment. A controller, not shown, receives data signals from the sensors and operates the motors M1, M2, and M3. The controller also receives data signals from the registration board and operates the cross-tracking stepper motor M2 to align the paper. The controller receives a signal from the user to indicate the size of the paper. If the paper is a non-standard size, the user may select input the actual size of the paper into the controller through a suitable touch screen or keyboard or combination of them. The controller then selects the light source 110 and array 130 that is closest in size to the non-standard size paper. The controller will adjust the output of the cross-tracing motor $M_2$ to align the paper with the centerline of the non-standard paper.

In operation, a user selects a standard size sheet or inputs at least one dimension of a non-standard size sheet. The controller selects a light source 110 and diode array 120 that corresponds to the selected size sheet. The light source is turned on. As each successive copy sheet enters the registration station, its leading edge interrupts the light from source 110. The leading edge casts a shadow on the diode array 130 and the last shadowed diode represents the length of the sheet. Parallax errors are corrected by a trigonometric program that is stored in and performed by the controller. By measuring the edge position and correcting for parallax, the machine knows whether or not to move the sheet forward or backward to the registered position for the particular sheet size. In this respect, the photodiodes are approximately 0.0025 inches on center. The stepper M2 operates the cross-tracking mechanism. It receives a signal from the controller that corresponds to the distance the sheet must be moved to register its centerline along the path P. The motor M2 is accurate enough to register the sheet with the toner image. It moves the sheet a distance that corresponds to the difference between the edge of the sheet and the centerline of the path. Then the sheet is released along the path to receive a toner image.

Having described an exemplary embodiment of the invention, those skilled in the art will appreciate that the embodiment may be modified by the addition of deletion of one or more of the components described above and by the substitution of equivalent components without departing from the spirit and scope of the a appended claims.

The invention claimed is:

1. A method for aligning a copy sheet to an image carrying member comprising:

disposing at least one linear array of photosensitive devices on one sides of a path of an edge of the copy sheet;

disposing a light source on the opposite side of the path of the copy sheet so that the copy sheet passes between the linear array and the light source;

feeding the copy sheet along a path between the linear array and the light source;

counting the number of devices covered by a shadow cast by an edge of the copy sheet on the linear array;

moving the copy sheet a distance corresponding to a distance equivalent to the number of pixels between the edge of the copy sheet and a reference registration location;

wherein the light source generates invisible radiation, and two or more linear arrays of photodetectors are disposed so that a portion of the one array overlaps a corresponding portion of the other array.

2. The method of claim 1 wherein the arrays are alternately opposite one another along parallel paths.

3. The method of claim 1 or 2 wherein each array has a corresponding light source for illuminating the array.

4. In an electrographic machine a registration station for registering an edge of a copy sheet to reference registration location, comprising:

deskew mechanism for driving the opposite edges of the copy sheet at selective different speeds along a path at different to straighten the leading edge of the copy sheet to be substantially transverse to its direction of travel;

at least one linear array of photosensitive devices on one side of the path of the copy sheet;

a light source on the opposite side of the path of the copy sheet for illuminating at least the leading edge of the copy sheet in a vicinity proximate the linear array so that the copy sheet casts a shadow on the linear array;

a registration mechanism for selectively engaging the copy sheet and moving the copy sheet in a direction transverse to its path and an amount corresponding to the difference between the number of photosensitive devices covered by the shadow cast by the copy sheet on the linear array and a reference registration location;

wherein the light source generates invisible radiation, and two or more linear arrays of photodetectors are disposed so that a portion of the one array overlaps a corresponding portion of the other array.

5. The machine of claim 4 wherein the arrays are alternately opposite one another along parallel paths.

6. The machine of claim 4 wherein each array has a corresponding light source for illuminating the array.

7. The method of claim 1 wherein the invisible radiation is infrared radiation.

8. The method of claim 1 comprising the further step of disposing multiple pairs of light sources and linear arrays for detecting edges of sheet of any length.

9. The machine of claim 4 wherein the invisible radiation is infrared radiation.

10. The machine of claim 4 further comprising multiple pairs of light sources and linear arrays for detecting edges of sheet of any length.

* * * * *